US008327923B2

(12) United States Patent
Steinbauer et al.

(10) Patent No.: US 8,327,923 B2
(45) Date of Patent: Dec. 11, 2012

(54) WOUND HEAT EXCHANGER WITH ANTI-DRUMMING WALLS

(75) Inventors: Manfred Steinbauer, Raisting (DE); Andre Biegner, Fuerth (DE); Reinhold Hoelzl, Geretsried (DE); Juergen Spreemann, Rosenheim (DE)

(73) Assignee: Linde Aktiengesellschaft, Munich (DE)

( * ) Notice: Subject to any disclaimer, the term of this patent is extended or adjusted under 35 U.S.C. 154(b) by 1097 days.

(21) Appl. No.: 11/996,272

(22) PCT Filed: Jul. 11, 2006

(86) PCT No.: PCT/EP2006/006789

§ 371 (c)(1),
(2), (4) Date: Jul. 9, 2008

(87) PCT Pub. No.: WO2007/009640

PCT Pub. Date: Jan. 25, 2007

(65) Prior Publication Data

US 2008/0296004 A1 Dec. 4, 2008

(30) Foreign Application Priority Data

Jul. 22, 2005 (DE) ..... 10 2005 034 949
Jul. 26, 2005 (EP) ..... 05016223

(51) Int. Cl.
*F28D 7/02* (2006.01)
*F28D 7/04* (2006.01)

(52) U.S. Cl. ..... 165/135; 165/163

(58) Field of Classification Search ..... 165/69, 165/135, 163

See application file for complete search history.

(56) References Cited

U.S. PATENT DOCUMENTS

| | | | | | |
|---|---|---|---|---|---|
| 1,973,100 | A | * | 9/1934 | Rawson | 165/69 |
| 2,508,247 | A | * | 5/1950 | Giauque | 165/163 |
| 3,349,842 | A | * | 10/1967 | Prybil | 165/163 |
| 3,357,484 | A | * | 12/1967 | Maher | 165/76 |
| 3,639,963 | A | * | 2/1972 | Maher | 29/890.037 |
| 3,720,259 | A | * | 3/1973 | Fritz et al. | 165/162 |
| 3,850,230 | A | * | 11/1974 | Margen | 165/66 |
| 4,036,289 | A | * | 7/1977 | Cheng et al. | 165/82 |
| 4,167,211 | A | * | 9/1979 | Haller | 165/78 |
| 4,735,260 | A | * | 4/1988 | Wohrl et al. | 165/69 |
| 5,845,609 | A | * | 12/1998 | Corrigan | 122/209.1 |

FOREIGN PATENT DOCUMENTS

| | | |
|---|---|---|
| CH | 683124 A5 | 1/1994 |
| DE | 1 501 519 | 6/1969 |
| DE | 1912 341 | 9/1970 |
| DE | 1 626 572 | 1/1971 |

(Continued)

OTHER PUBLICATIONS

Hausen/Linde, Tieftemperaturtechnik (Cryogenic Engineering), 2nd ed., 1985, pp. 470-475.

(Continued)

*Primary Examiner* — Allen Flanigan
(74) *Attorney, Agent, or Firm* — Crowell & Moring LLP

(57) ABSTRACT

A wound heat exchanger is disclosed. The heat exchanger includes a plurality of tubes which are wound in several concentric tube layers about a central tube, and a container cover which defines an external chamber about the tube. A first anti-drumming wall is shaped as a cylinder cover or a cylinder cover segment and is arranged on the external side of a first layer of tubes.

11 Claims, 1 Drawing Sheet

FOREIGN PATENT DOCUMENTS

| | | | |
|---|---|---|---|
| DE | 27 36 489 | A1 | 2/1979 |
| DE | 195 17 114 | A1 | 10/1996 |
| DE | 197 07 475 | A1 | 8/1998 |
| DE | 198 48 280 | A1 | 4/2000 |
| DE | 20 2005 012 162 | U1 | 10/2005 |

OTHER PUBLICATIONS

W. Scholz, Gewickelte Rohrwaermeaustauscher (Wound Tube Heat Exchangers), Linde Reports on Science and Technology, No. 33 (1973), pp. 34-39.

Kreis, Gewickelte Waermeaustauscher (Wound Heat Exchangers), Hess, Apparatus Handbook: Technology, Construction, Application, 1990, pp. 262-264.

W. Bach, Offshore Erdgasverfluessigung mit Stickstoffkaelte—Prozessauslegung und Vergleich von Gewickelten Rohr-und Plattenwaermetauschern (Offshore Natural Gas Liquefaction with Nitrogen Cold Process Design and Comparison of Wound Tube and Plate Heat Exchangers), Linde Reports on Science and Technology, No. 64 (1990), pp. 31-37.

W. Förg et al., Ein neuer LNG Baseload Prozess und die Herstellung der Hauptwaermeaustauscher (A New LNG Baseload Process and Manufacturing of the Main Heat Exchanger), Linde Reports on Science and Technology, No. 7B (1999), pp. 3-11.

* cited by examiner

Fig. 1
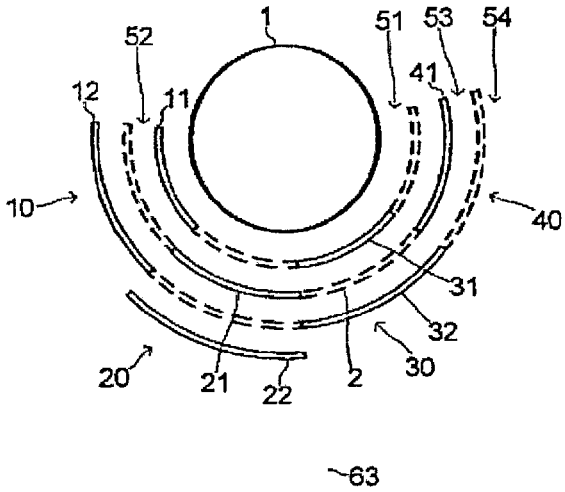
Fig. 2
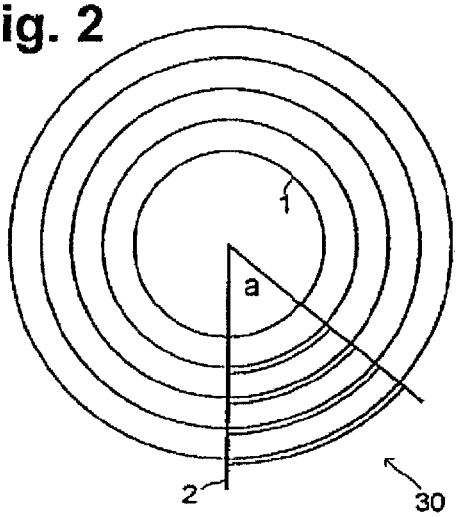
Fig. 3
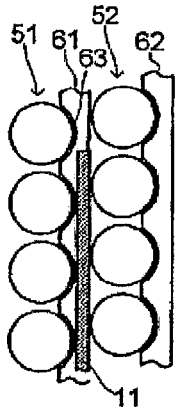
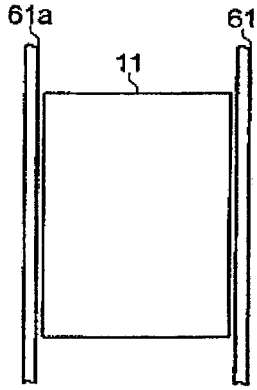
Fig. 4

WOUND HEAT EXCHANGER WITH ANTI-DRUMMING WALLS

This application claims the priority of International Application No. PCT/EP2006/006789, filed Jul. 11, 2006, German Patent Document No. 10 2005 034 949.8, filed Jul. 22, 2005, and European Patent Document No. 05016223.9, filed Jul. 26, 2005, the disclosures of which are expressly incorporated by reference herein.

BACKGROUND AND SUMMARY OF THE INVENTION

The invention relates to a wound heat exchanger with a tube bundle of a plurality of tubes, which are wound around a core tube, and with a cover, which defines an external chamber around the tube.

Natural gas is continuously liquefied in large quantities in LNG baseload systems. Most of the time, liquefaction of natural gas is accomplished by heat exchange with a coolant in wound heat exchangers. However, many other applications of wound heat exchangers are also known.

In a wound heat exchanger, several layers of tubes are spirally wound on a core tube. A tube bundle is formed by this type of tube winding. A wound heat exchanger contains at least one tube bundle, but it may also have two or more tube bundles. A first medium is piped through the inside of at least one portion of the tubes, and this medium exchanges heat with a second medium flowing in the chamber between the tubes and a surrounding cover. The tubes are merged into several groups above and/or below the tube bundle and fed out of the external chamber in a bundled manner using collectors (headers).

These types of wound heat exchanger and their application, for example for liquefaction of natural gas, are described in each of the following publications:

Hausen/Linde, Cryogenic Engineering, $2^{nd}$ ed., 1985, pages 471-475;

W. Scholz, "Wound Tube Heat Exchangers," Linde Reports on Science and Technology, No. 33 (1973), pages 34-39;

Kreis, "Wound Heat Exchangers" in Hess, Apparatus Handbook: Technology, Construction, Application, 1990, pages 262-264;

W. Bach, "Offshore Natural Gas Liquefaction with Nitrogen Cold Process Design and Comparison of Wound Tube and Plate Heat Exchangers," Linde Reports on Science and Technology, No. 64 (1990), pages 31-37;

W. Förg et al., "A New LNG Baseload Process and Manufacturing of the Main Heat Exchanger," Linde Reports on Science and Technology, No. 78 (1999), pages 3-11 (English version: W. Förg et al., "A New LNG Baseload Process and Manufacturing of the Main Heat Exchanger," Linde Reports on Science and Technology, No. 61 (1999), pages 3-11);

DE 1501519 A;

DE 1912341 A;

DE 19517114 A;

DE 19707475 A; and

DE 19848280 A.

The invention is based on the objective of reducing acoustic emissions from these types of wound heat exchangers.

This objective is attained by the installation of anti-drumming walls, which are shaped like a cylinder cover or preferably a cylinder cover segment, whereby at least one first anti-drumming wall is arranged on the external side of a first layer of tubes.

The anti-drumming wall prevents or reduces the formation of stationary acoustical waves between the core tube and the container wall. As a result, the noise emission during operation of the heat exchanger can be reduced effectively. An anti-drumming wall differs from walls for guiding flow or for separating chambers, as known from CH 683124 or DE 1501519, in that on a portion of the tangential extension (of the circumference) and/or the axial extension (of the length) of the tube bundle, they are permeable for the fluid flowing in the external chamber.

In this case, the terms "tangential," "radial" and "axial" refer to the axis of the core tube of the tube bundle.

The anti-drumming wall is comprised preferably of a solid material, for example a metal sheet, plastic plate or a plastic-coated metal sheet.

They must be sufficiently rigid so that they themselves are not excited to produce acoustic vibrations during operation of the heat exchanger. They should not have any holes.

All geometric information such as cylinder shape, conformity of lines and surfaces, etc. are not meant to be understood in a precise mathematical manner, but approximately within the framework of the concrete technical implementation of corresponding components.

The axial extension of the anti-drumming wall is less than the axial extension of the tube bundle. For example, it is less than 80%, preferably less than 50% of the axial extension of the tube bundle. In addition or alternatively, the tangential extension of the anti-drumming wall is less than 360°, in particular less than or equal to 180°, for example less than or equal to 90°. Two or more of these types of anti-drumming walls are preferably arranged tangentially, axially and/or radially offset from one another.

Basically, an anti-drumming wall can also be arranged on the external side of the bundle, preferably, however, between the first tube layer and a second tube layer adjacent to the first. Of course, a combination of external anti-drumming walls and anti-drumming walls arranged in intermediate layers is expedient.

It is advantageous if several cylindrical anti-drumming walls are arranged consecutively in the radial direction in that a first group of anti-drumming walls, which has at least two anti-drumming walls as the first and the second elements respectively, wherein the first element of the first group is arranged between the first and second tube layers and the second element of the first group is arranged between a third and a fourth tube layer adjacent to the third, wherein the axial edges of all elements of the first group lie on the leg surfaces of a first cylinder segment with an angle $\alpha$, and wherein the axis of the cylinder segment runs on the core tube axis.

As a result of this, the radial spacing of the anti-drumming walls can be coordinated with the wavelength of the noise being dampened.

No anti-drumming wall is preferably arranged within the first cylinder segment between the second and the third tube layers, i.e., one or more tube layers within the cylinder segment are free and make radial fluid exchange in the external chamber possible.

For example, an anti-drumming wall is arranged periodically in every nth tube layer within the cylinder segment, whereby n is greater than 2.

In order to also facilitate the radial exchange of fluid in the external chamber, it is advantageous for the anti-drumming walls to be arranged tangentially and radially offset. For this purpose, a second group of anti-drumming walls is used, which have at least one first element, wherein the axial edges of all elements of the second group lie on the leg surfaces of a second cylinder segment with an angle $\beta$, the axis of the second cylinder segment runs on the core tube axis and the first and second cylinder cover segments are essentially disjoint and in particular have precisely one common leg surface. In this connection, one element of the second group in particular is arranged between the second and third tube layers.

The sum of angles α and β is preferably equal to a whole number that is a fractional amount of 360°, at most the angles α and β are preferably equal. As a result, the entire angular area can be covered regularly by anti-drumming walls that are arranged in an offset manner.

Axial bars having guides for the tubes are frequently arranged between two adjacent tube layers. In this case, it is advantageous if at least one anti-drumming wall extends in the tangential direction between two adjacent bars. This is preferably realized in the case of all anti-drumming walls. The bars then define the leg areas of the aforementioned cylinder segments.

The invention also relates to the application of this type of heat exchanger for executing an indirect heat exchange between a hydrocarbonaceous stream and at least one heat fluid or cold fluid.

In this case, the hydrocarbonaceous stream is formed by natural gas, for example.

The hydrocarbonaceous stream is liquefied, cooled, heated and/or vaporized during the indirect heat exchange. The heat exchanger is preferably used for natural gas liquefaction or natural gas vaporization.

BRIEF DESCRIPTION OF THE DRAWINGS

The invention, as well as additional details about the invention, is explained in greater detail in the following on the basis one exemplary embodiment depicted roughly schematically in the drawings. The drawings show:

FIGS. 1 and 2 show a cross-sectional representation of the tube bundle of an inventive heat exchanger in a horizontal (radial) plane perpendicular to the core tube axis, FIG. 3 illustrates a portion of a cross section in a vertical plane running through the core tube axis, and FIG. 4 illustrates the unwound portion of a cylinder cover segment.

DETAILED DESCRIPTION OF THE DRAWINGS

FIG. 1 shows four groups 10, 20, 30, 40 of anti-drumming walls 11, 12, 21, 22, 31, 32, 41. In this case, only the first three or four tube layers 51 through 54 are depicted schematically (as intermediate areas between the anti-drumming walls or between the core tube and anti-drumming walls), which extend concentrically around a core tube 1. Additional tube layers can be attached outwardly.

The anti-drumming walls 11, 12 are elements of the first group 10 of anti-drumming walls. The anti-drumming walls 21, 22 are elements of the second group 20 of anti-drumming walls. The anti-drumming walls 31, 32 are elements of the third group 30 of anti-drumming walls. Only one element 41 of the fourth group 40 of anti-drumming walls is shown. Each of the groups defines an abstract cylinder segment 2 with opening angle α, as illustrated in FIG. 2 for one group.

In the example all groups extend over the same angle α, which is equal to 60° (not shown to scale in the drawing). Overall, six groups thus cover the entire angle area ab (not shown). Alternatively, α can assume any other value of 360°/2 n or 360°/n (n=natural number).

Remaining radially and tangentially between two anti-drumming walls respectively is an empty intermediate space (for example 2) that is shown as a dashed line between two adjacent tube layers (for example 52, 53).

The anti-drumming walls 11, 12, 21, 22, 31, 32, 41 can extend over the entire height (axial extension) of the tube bundle (perpendicular to the drawing plane of FIGS. 1 and 2) or also only cover a portion of this height. In the latter case, additional corresponding sets of anti-drumming walls can be located above and/or below. It is also possible to provide only a portion of the height of the heat exchanger with anti-drumming walls.

FIG. 3 shows a section of four tubes each from two adjacent tube layers 51, 52. The tubes from each layer 51, 52 are wound on bars 61, 62, which have corresponding recesses 63 as guides for the tubes. At the depicted location, the anti-drumming wall 11 from FIG. 1 is arranged at the side of the bar 61 facing the observer. The anti-drumming wall 21 from FIG. 1 (not shown in FIG. 3) is situated at the side of the bar 62 facing away from the observer.

The unwound portion in FIG. 4 shows the arrangement of the anti-drumming wall 11 between the bar 61 and the adjacent bar 61*a* of the same tube layer 51.

The invention claimed is:

1. A wound heat exchanger with a tube bundle of a plurality of tubes, which are wound in several concentric tube layers around a core tube, and with a container cover, which defines an external chamber around the tubes, wherein an anti-drumming wall is shaped like a cylinder cover or a cylinder cover segment and is arranged on an external side of a first layer of tubes, wherein an axial extension of the anti-drumming wall is less than an axial extension of the tube bundle, and wherein a tangential extension of the anti-drumming wall is less than 360°, wherein a first group of anti-drumming walls has said anti-drumming wall as one of at least two anti-drumming walls as first and second elements, wherein the first element of the first group is arranged between the first layer and a second layer of tubes and the second element of the first group is arranged between a third layer of tubes and a fourth layer of tubes adjacent to the third layer of tubes, wherein axial edges of the first and second elements of the first group lie on leg surfaces of a first cylinder segment with an angle α, wherein an axis of the first cylinder segment runs on a core tube axis, wherein within the first cylinder segment no anti-drumming wall is arranged between the second and the third layers of tubes, wherein a second group of anti-drumming walls has axial edges that lie on leg surfaces of a second cylinder segment with an angle β, wherein an axis of the second cylinder segment runs on the core tube axis, wherein the first and second cylinder segments are disjoint and have a common leg surface, and wherein a sum of said angles α and β is equal to a whole number that is a fractional amount of 360°.

2. The heat exchanger according to claim 1, wherein the tangential extension of the anti-drumming wall is less than or equal to 180°.

3. The heat exchanger according to claim 1, wherein the anti-drumming wall is arranged between the first layer of tubes and the second layer of tubes, which is adjacent to the first layer of tubes.

4. The heat exchanger according to claim 1, wherein one element of the second group of anti-drumming walls is arranged between the second and third layers of tubes.

5. The heat exchanger according to claim 1, wherein the angles α and β are equal.

6. The heat exchanger according to claim 1, wherein axial bars having guides for the tubes are arranged between two adjacent tube layers, and wherein the anti-drumming wall extends in a tangential direction between two adjacent axial bars.

7. A wound heat exchanger, comprising:

a core tube;

a first layer of tubes wound concentrically around the core tube;

a second layer of tubes wound concentrically around the first layer of tubes; and an anti-drumming wall arranged between the first and second layers of tubes, wherein an axial extension of the anti-drumming wall is less than an axial extension of the first and second layers of tubes, and wherein a tangential extension of the anti-drumming wall is less than 360°, wherein a first group of anti-drumming walls has said anti-drumming wall as one of at least two anti-drumming walls as first and second elements, wherein the first element of the first group is arranged between the first layer and a second layer of tubes and the second element of the first group is arranged between a third layer of tubes and a fourth layer of tubes adjacent to the third layer of tubes, wherein axial edges of the first and second elements of the first group lie on leg surfaces of a first cylinder segment with an angle α, wherein an axis of the first cylinder segment runs on a core tube axis, wherein within the first cylinder segment no anti-drumming wall is arranged between the second and the third layers of tubes, wherein a second group of anti-drumming walls has axial edges that lie on leg surfaces of a second cylinder segment with an angle β, wherein an axis of the second cylinder segment runs on the core tube axis, wherein the first and second cylinder segments are disjoint and have a common leg surface, and wherein a sum of said angles α and β is equal to a whole number that is a fractional amount of 360°.

8. The heat exchanger according to claim 7, wherein the third layer of tubes is wound concentrically around the second layer of tubes;

wherein the fourth layer of tubes is wound concentrically around the third layer of tubes; and wherein a second anti-drumming wall arranged between the third and fourth layers of tubes, an axial extension of the second anti-drumming wall is less than an axial extension of the third and fourth layers of tubes, and a tangential extension of the second anti-drumming wall is less than 360°.

9. The heat exchanger according to claim 8, wherein the anti-drumming wall and the second anti-drumming wall lie within leg surfaces of a first cylinder segment with an angle α.

10. The heat exchanger according to claim 9, further comprising a third anti-drumming wall arranged between the second and third layer of tubes, wherein an axial extension of the third anti-drumming wall is less than the axial extension of the second and third layers of tubes, and wherein a tangential extension of the third anti-drumming wall is less than 360°.

11. The heat exchanger according to claim 10, wherein the third anti-drumming wall lies within leg surfaces of a second cylinder segment with an angle β and wherein the first cylinder segment is adjacent to the second cylinder segment.

* * * * *